US005765248A

United States Patent [19]

Ono

[11] Patent Number: 5,765,248

[45] Date of Patent: Jun. 16, 1998

[54] SHORE

[76] Inventor: Tatsuo Ono, 5-20-13, Matsugaoka, Funabashi, Chiba, Japan

[21] Appl. No.: 683,964

[22] Filed: Jul. 19, 1996

[30] Foreign Application Priority Data

Jul. 20, 1995 [JP] Japan ..... 7-206477

[51] Int. Cl.[6] ..... E01D 19/02; E01D 21/00

[52] U.S. Cl. ..... 14/75; 14/77.3; 182/152; 182/178.1; 248/188.6; 248/351; 248/436; 52/637

[58] Field of Search ..... 14/75, 77.1, 2.4, 14/77.3; 182/27, 152–155, 178.1, 178.2, 223; 248/188.6, 436, 351; 52/637

[56] References Cited

U.S. PATENT DOCUMENTS 4,015,303 4/1977 Eyb et al. ..... 14/75

FOREIGN PATENT DOCUMENTS 7-8416 2/1995 Japan .

*Primary Examiner*—James Lisehora
*Attorney, Agent, or Firm*—McGlew and Tuttle

[57] ABSTRACT

Disclosed is a shore which has a durability with respect to loads not only in a longitudinal direction and a lateral direction but also in a lengthwise direction, and which can be automatically folded without requiring extra work.

The shore comprising a pair of front and rear fixed frames 10, a pair of left and right foldable reinforcing frames 11 interposed between both left and right ends of each of the fixed frames, and a pair of front and rear floor plates 12 whose proximal ends are pivotally mounted to an inner intermediate portion of each of the fixed frames, characterized in that said reinforcing frame comprises a folding handrail column 13 whose proximal end is pivotally mounted between upper ends of the fixed frame, four expandable braces 14 whose proximal ends are pivotally mounted to upper and lower ends of each of the fixed frames and obliquely extending toward the inner intermediate portion, a support member 15 comprising a flange 16 for pivotally mounting an extreme end of each brace 14 and a guide tube 17 provided on the back surface of the flange, a support rod 18 whose proximal end is secured to the intermediate portion of said handrail column 13 and whose lower end is secured into or slidably and selectively inserted into said guide tube, and a bracket 19 provided at the lower end of said support rod and for rotatably connecting the extreme end of said floor plates.

14 Claims, 14 Drawing Sheets

SHORE

BACKGROUND OF THE INVENTION

The present invention relates, in the case where heavy articles, for example, such as bridge girders, large trusses, etc. are constructed in bridge works, various buildings and civil works, to a shore for supporting blocks such as these bride girders, large trusses, etc.

In general, for example, in the case where in bridge works, bridge girders are constructed on bridge piers, a bridge girder block fabricated in advance into suitable sizes in a factory is transported to a construction site, the block is then temporarily received on a shore while being hung by means of a crane, and the block thus temporarily received on the shore is further joined to another block and thereafter is arranged on the bridge girder. In this case, the shore is disassembled or removed after the bridge girders have been arranged on the bridge piers.

The assembling and disassembling of the shore at the work site is poor in working efficiency and inferior in economical efficiency. In this case, for example, as disclosed in Japanese Utility Model Laid-Open No. 8416/1995 publication, a folding shore has been recently developed, in which the shore is folded in a compact manner during transportation, and when in use at the site, the shore is unfolded into a cubic form. Thus, this shore can be used in different sites without assembling and disassembling each time.

The shore disclosed in the above publication comprises, as shown in FIG. 17, a pair of opposed fixed frames 1, 1, a pair of foldable reinforcing frames 2, 2 pivotally mounted to both left and right ends of the fixed frames, respectively, and a floor plate whose proximal end is rotatably pivotally mounted to inner intermediate portions of the fixed frames 1, 1.

In this case, the reinforcing frame 2 comprises a folding handrail column 4 pivotally mounted between upper ends of a column 3 constituting the fixed frame 1, a folding horizontal member 5 pivotally mounted halfway between columns 1, 1, braces 6, 6 pivotally mounted halfway between the upper ends of the columns 1, 1 and the horizontal member 5, and a vertical member 7 constructed in halfway between the handrail column 4 and the horizontal member 5. When in use, the reinforcing frame 2 is unfolded into a cubic form as shown, while when out of use, for example, during transportation, the lower ends of the braces 6, 6 are disengaged from the horizontal member 5, and when they are then compressed by their own weight in a longitudinal direction, the reinforcing frame 2 is folded to assume a compact configuration in its entirety.

However, in the above-described conventional shore, the reinforcing frame 2 is of the folding construction, only two braces 6 are present upwardly, and the reinforcing member is not present at a level below the horizontal member 5. Therefore, the shore has a durability and a strength with respect to loads in a vertical and lateral direction as indicated by arrows A and B and is free from possible deformation. However, the shore is weak with respect to a load in a longitudinal direction indicated by arrow C due to vibrations, and is possibly deformed in a compression direction as the case may be.

Furthermore, when the shore is folded compactly, it is necessary to disengage the lower end of the brace 6 from the pivot of the horizontal member 5 each time, thus posing an inconvenience of materially lowering the work efficiency.

SUMMARY OF THE INVENTION

It is therefore an object of the present invention to provide a shore which has a durability with respect to loads not only in a vertical and lateral direction but also in a longitudinal direction, and which can be automatically folded without requiring extra work.

For achieving the above-described object, the present invention provides a shore comprising a pair of fixed frames opposed to each other, a pair of foldable reinforcing frames interposed between both ends of each of the fixed frames, and floor plates whose proximal end is pivotally mounted to an inner intermediate portion of each of the fixed frames, characterized in that said reinforcing frame comprises a folding handrail column whose proximal end is pivotally mounted between upper ends of the fixed frame, four expandable braces whose proximal ends are pivotally mounted to upper and lower ends of the fixed frames and obliquely extending toward the inner intermediate portion, a support member comprising a flange for pivotally mounting an extreme end of each brace and a guide tube provided on the back surface of the flange, a support rod whose proximal end is secured to the intermediate portion of said handrail column and whose lower end is secured into or slidably and selectively inserted into said guide tube, and a bracket provided at the lower end of said support rod and for rotatably connecting the extreme end of said floor plate.

In this case, preferably, the fixed frame comprises a pair of left and right hollow pipe columns, a set of two upper and lower flanges provided at upper and lower ends of the pipe columns at any intervals, two upper and lower handrail columns constructed through said flanges between the upper ends of the pipe columns and between the lower ends thereof, four braces whose proximal ends are connected to the upper and lower ends of the pipe columns through said lower flange and whose extreme ends extend obliquely towards the inner intermediate portion, and a support plate for connecting the extreme end of each of the braces.

Preferably, the expandable brace comprises an outer tube, an inner rod slidably inserted into said outer tube, and a pin insert hole diametrically bored on the upper part of the outer tube.

Preferably, the folding handrail column comprises a pair of front and rear columns, and a bracket in which the extreme end of each column is pivotally mounted, and the upper end of the support rod is connected to a support piece extended horizontally from said bracket.

Further, a plurality of foldable reinforcing frames and a floor plate may be interposed between a pair of longitudinally lengthy fixed frames.

Further, a plurality of shores may be connected detachably in a vertical direction.

Still further, preferably, the proximal end of the folding handrail column and the proximal ends of the four expandable braces are pivotally mounted to one out of the set of two upper and lower flanges provided on the pipe columns.

DESCRIPTION OF THE PREFERRED EMBODIMENTS

The embodiments of the present invention will be described hereinafter with reference to the drawings.

FIGS. 1 to 12 show the shore according to one embodiment of the present invention.

Figure 1:
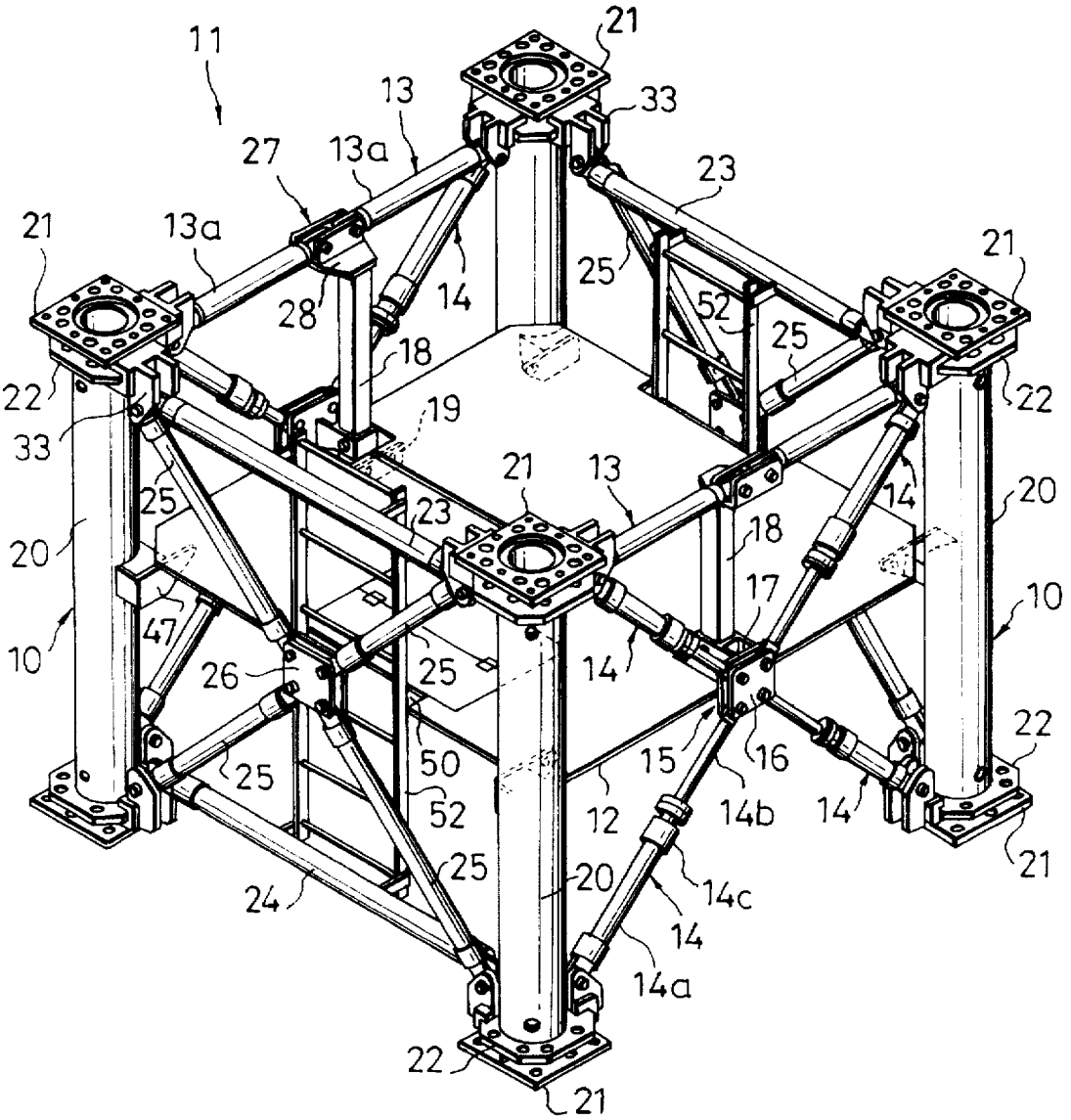
FIG. 1 is a perspective view of the shore according to one embodiment of the present invention.

The shore comprises, as shown in FIG. 1, a pair of front and rear fixed frames 10, 10, a pair of left and right foldable reinforcing frames 11, 11 interposed between both left and right ends of each of the fixed frames 10, 10, and a pair of front and rear floor plates 12, 12 whose proximal ends are pivotally mounted to an inner intermediate portion of each of the fixed frames 10, 10.

Said reinforcing frame 11 comprises a folding handrail column 13 whose proximal end is pivotally mounted between upper ends of the fixed frame 10, four expanable braces 14 whose proximal ends are pivotally mounted to upper and lower ends of each of the fixed frames 10 and obliquely extending toward the inner intermediate portion, a support member 15 comprising a flange 16 for pivotally mounting an extreme end of each brace 14 and a guide tube 17 provided on the back surface of the flange 14, a support rod 18 whose proximal end is secured to the intermediate portion of said handrail column 13 and whose lower end is secured into or slidably and selectively inserted into said guide tube 17, and a bracket 19 provided at the lower end of said support rod 18 and for rotatably connecting the extreme end of said floor plates 12.

The fixed frame 10 comprises a pair of left and right hollow pipe columns 20, 20, a set of two upper and lower flanges 21, 22 provided at upper and lower ends of the pipe columns 20 at any intervals, two upper and lower handrail columns 23, 24 constructed through said flange 22 between the upper ends of the pipe columns 20 and between the lower ends thereof, four braces 25 whose proximal ends are connected to the upper and lower ends of the pipe columns 20 through said one flange 22 and whose extreme ends extend obliquely towards the inner intermediate portion, and a support plate 26 for connecting the extreme end of each of the braces 25.

The expandable brace 14 comprises an outer tube 14*a*, an inner rod 14*b* slidably inserted into said outer tube 14*a*, and a pin insert hole 14*c* diametrically bored on the upper part of the outer tube 14*a*.

The folding handrail column 13 comprises a pair of front and rear columns 13*a*, 13*a*, and a bracket 27 in which the extreme ends of each column 13*a*, 13*a* are pivotally mounted, and the upper end of the support rod 18 is connected to a support piece 28 extended horizontally from said bracket 27.

Figure 2:
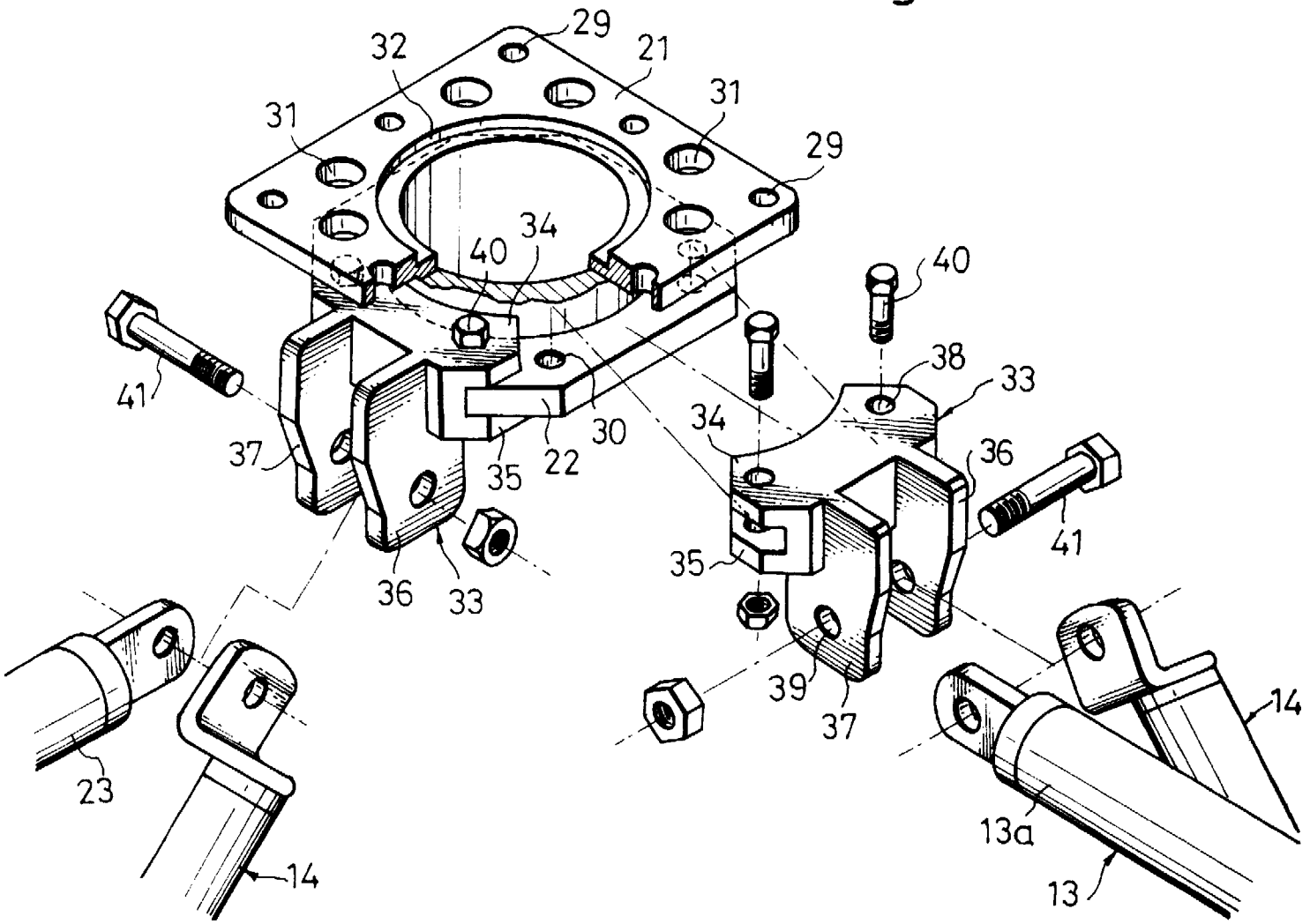
FIG. 2 is a partly enlarged perspective view of FIG. 1.

As shown in FIG. 2, the flanges 21, 22 provided at the upper and lower ends of the pipe column 20 are such that one flange 21 is wider than the other flange 22. The flanges 21, 22 are formed with bolt mounting holes 29, 30, respectively. One flange 21 is formed with a large diameter hole 31 opposed to the mounting hole 30 of the other flange 22.

At the upper end of the pipe column 20, the wide flange 21 is arranged on the upper part, and at the lower end of the pipe column 20, the wide flange 21 is arranged on the lower part, so that when another shore is provided vertically, the upper and lower flanges 21, 21 of each shore are placed in contact with each other and fastened by bolts inserted into the mounting holes 29.

The flange 21 is formed in the center thereof with a hole 32 opposed to the hole of the pipe column 20 so that the mounting portion at the lower end of the pipe column 20 in the shore provided upwardly can be inserted therein.

The other flange 22 is connected to the pipe column 20 at any intervals with respect to one flange 21, and the handrail columns 13, 23, 24 and the brace 14 are rotatably mounted on the flange 21 through a mounting bracket 33.

The mounting bracket 33 comprises horizontal forked holding pieces 34, 35, two mounting pieces 36, 36 connected to the back of the holding pieces 34, 35, bolt holes 38 provided in the longitudinal direction of the holding pieces 34, 35, and bolt holes 39 provided in the lateral direction of the mounting pieces 36, 36.

The holding pieces 34, 35 of two brackets 33, 33 are inserted into the corner of the flange 22 and thereafter fastened by bolts 40. The proximal ends of the handrail column 23 constituting the fixed frame 10 and the brace 14 constituting the reinforcing frame 11 are rotatably and pivotally mounted to the mounting pieces 36, 36 of one bracket 33, and the proximal ends of the handrail column 13 constituting the reinforcing frame 11 and the brace 14 are rotatably and pivotally mounted to the mounting pieces 36, 36 of the other bracket 33.

A bolt 40 is inserted into the large diameter hole 31 formed in the wide flange 21, which bolt is fallen into a bolt hole 38 of the holding pieces 34, 35. This is because a clearance between two flanges 21 and 22 is so small that the bolt 40 is hard to be inserted in a lateral direction of the clearance.

Figure 3:
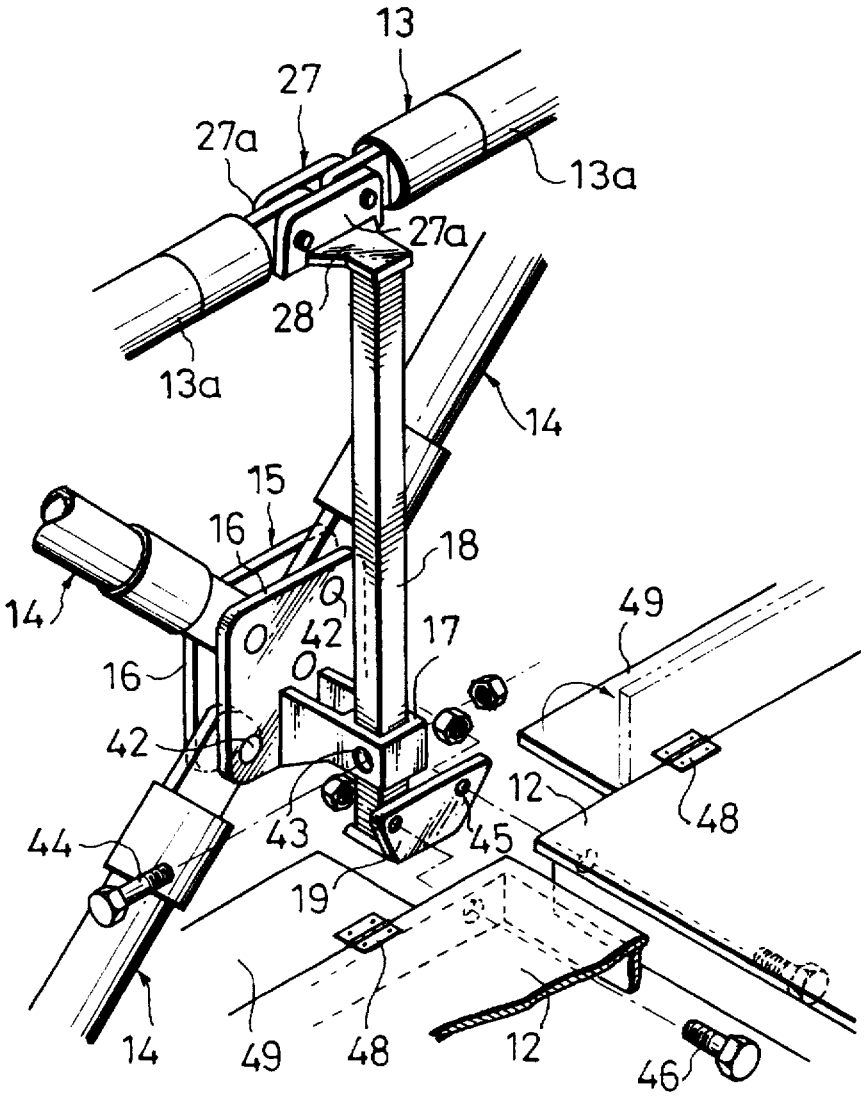
FIG. 3 is a partly enlarged perspective view of FIG. 1.
Figure 4:
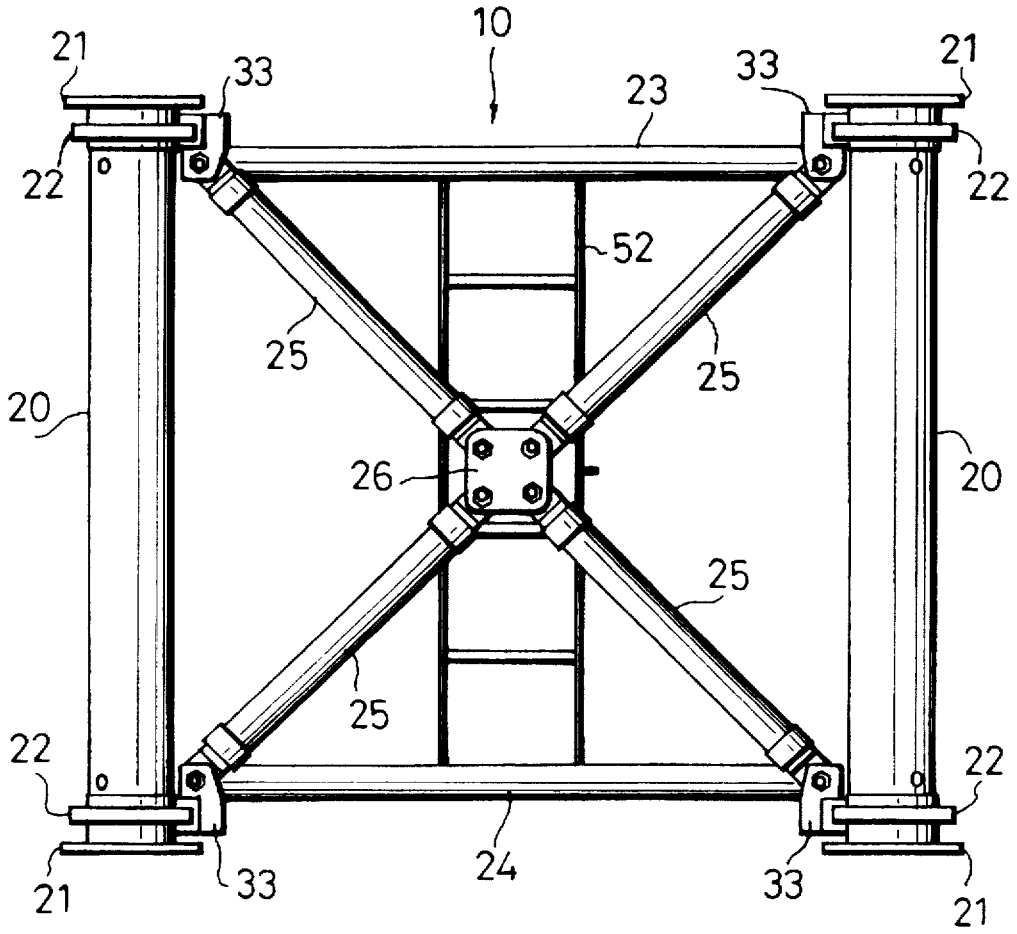
FIG. 4 is a front view of a fixed frame shown in FIG. 1.
Figure 5:
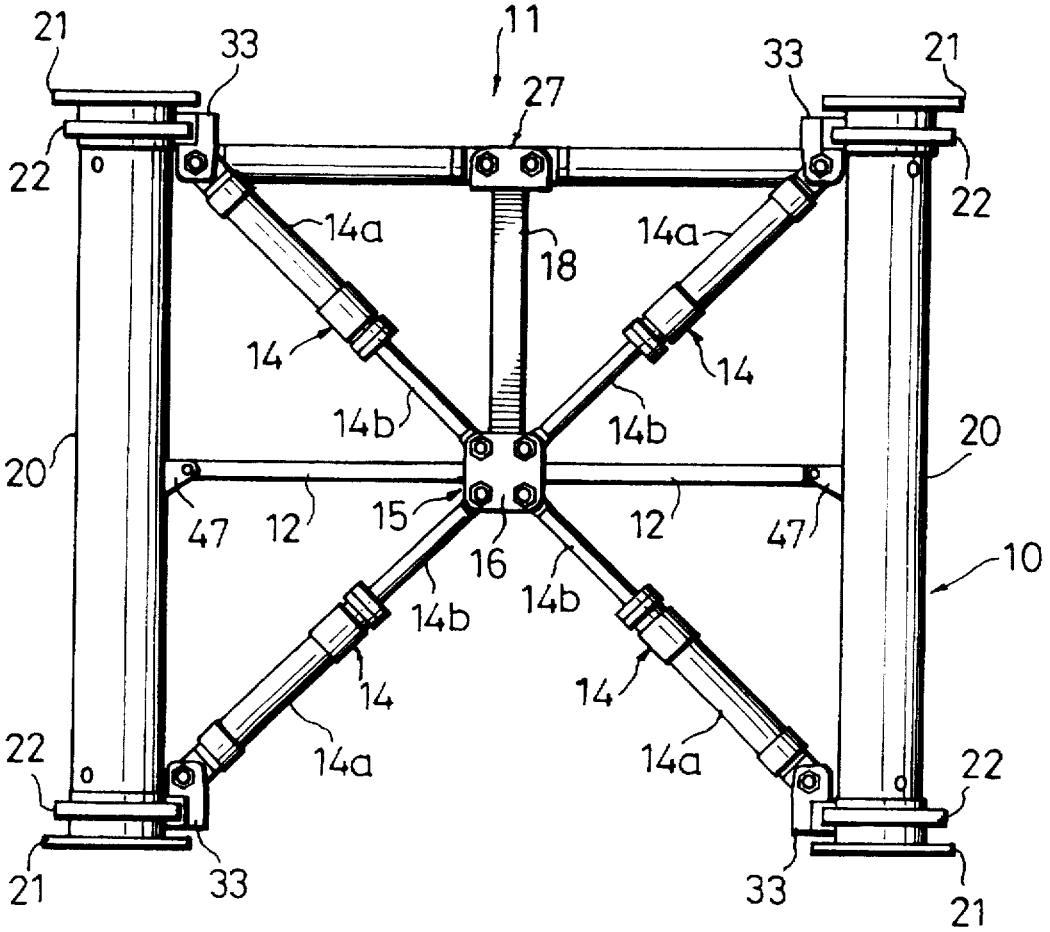
FIG. 5 is a right side view of a reinforcing frame shown in FIG. 1.
Figure 6:
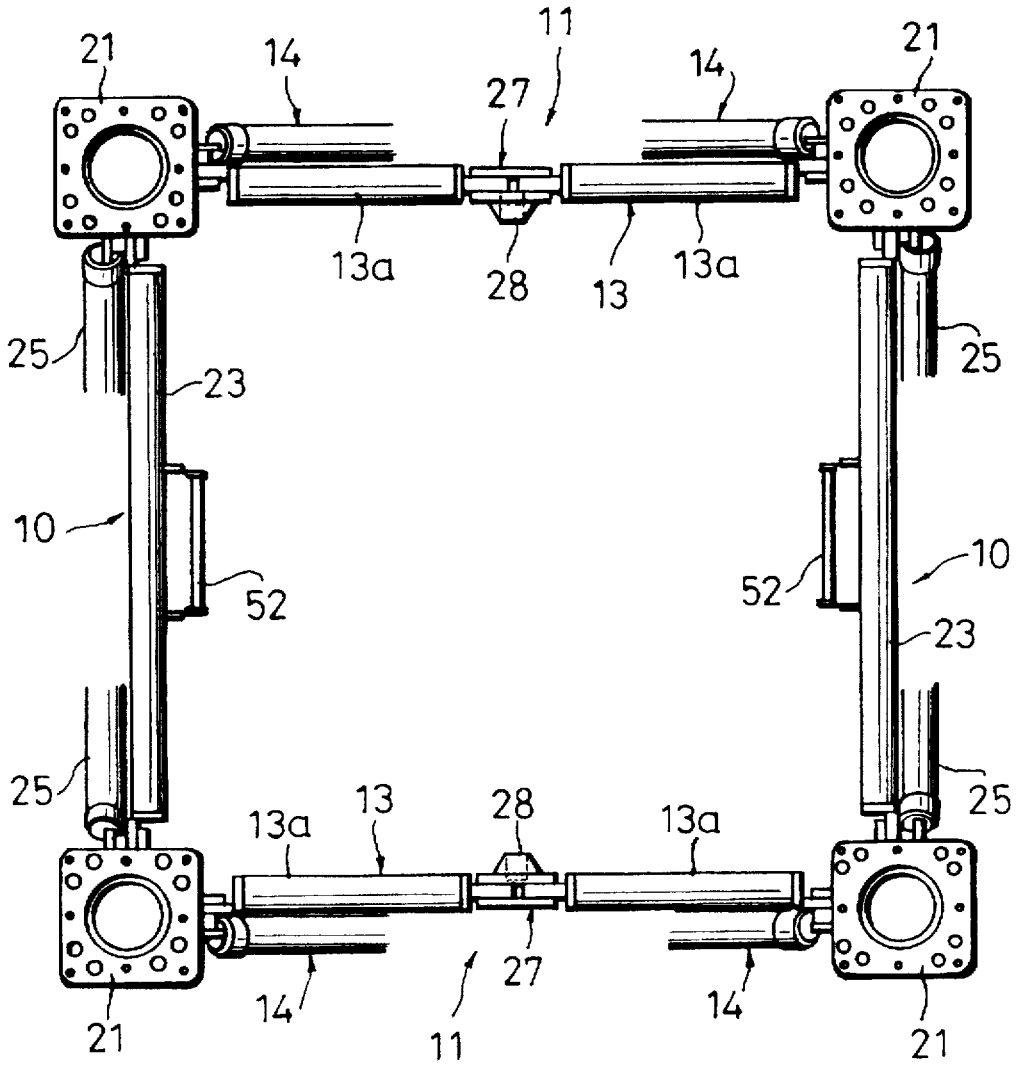
FIG. 6 is a plan view of the fixed frame and the reinforcing frame shown in FIG. 1.

As shown in FIG. 3, the support member 15 provided in the middle on the reinforcing frame 11 side comprises two flanges 16, 16 having a suitable clearance provided therebetween, and a hollow guide tube 17 extended horizontally from the back surface of one flange 16. The extreme ends of four presses 14 are inserted into the clearance between the two flanges 16, 16 and are rotatably and pivotally mounted through pins 42.

The bracket 27 pivotally mounted to the extreme end of the handrail column 13 has two holding pieces 27*a*, 27*a*, one holding piece 27*a* being integrally provided with a support piece 28 in a horizontal direction, and the upper end of the support rod 18 is connected to the lower end of the support piece 28. The support rod 18 is vertically and slidably inserted into the guide tube 17, and the lower end thereof projects downwards from the guide tube 17.

The guide tube 16 and the support rod 18 are laterally formed with bolt holes 43 opposed to each other so that a bolt 44 is detachably inserted into the bolt hole 43. When the support rod 18 is moved upwards and the shore itself is assembled into a cubic or rectangular box, the support rod 18 and the guide tube 16 are connected by the bolt 44. When the shore is folded, the bolt 44 is drawn out and the support rod 18 is slidably moved downwards along the guide tube 16. Further, the bracket 19 is connected to the back surface at the lower end of the support rod 18, and the extreme end sides of the floor plates 12, 12 are rotatably and pivotally mounted to two bolt holes 45, 45 formed in the bracket 19.

The proximal ends of the floor plates 12, 12 are rotatably and pivotally mounted through pins to an arm 47 provided substantially in the middle of the pipe column 20 as shown in FIG. 1, whereby the floor plates 12, 12 are normally constructed between the arm 47 and the bracket 19 to maintain a horizontal state, and when folding, the proximal end thereof uses the arm 47 as a supporting point, and the extreme end side moves downwards along with the support rod 18.

A projecting plate 49 is foldably connected to the outer end of the floor plate 12 through a hinge 48 so as to close a clearance on the side of the floor 12. Alternatively, an upwardly erecting integral baseboard may be provided in place of the projecting plate 49.

Figure 7:
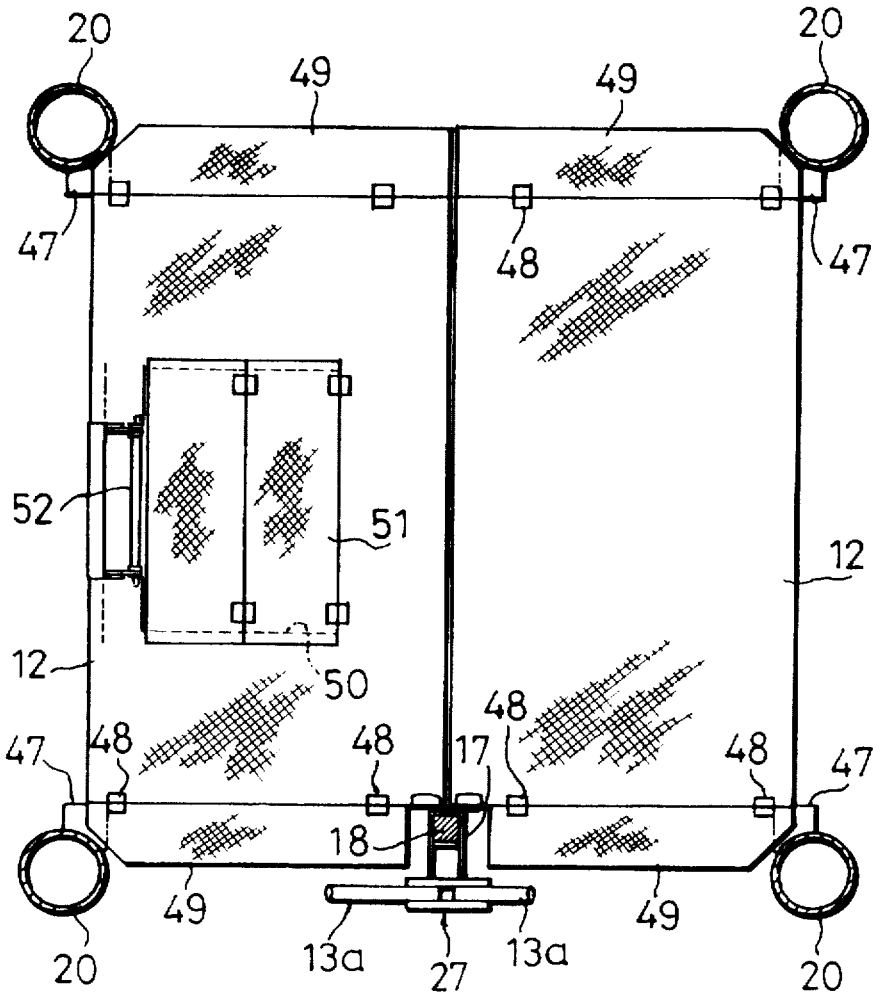
FIG. 7 is a plan view of a floor plate shown in FIG. 1.
Figure 8:
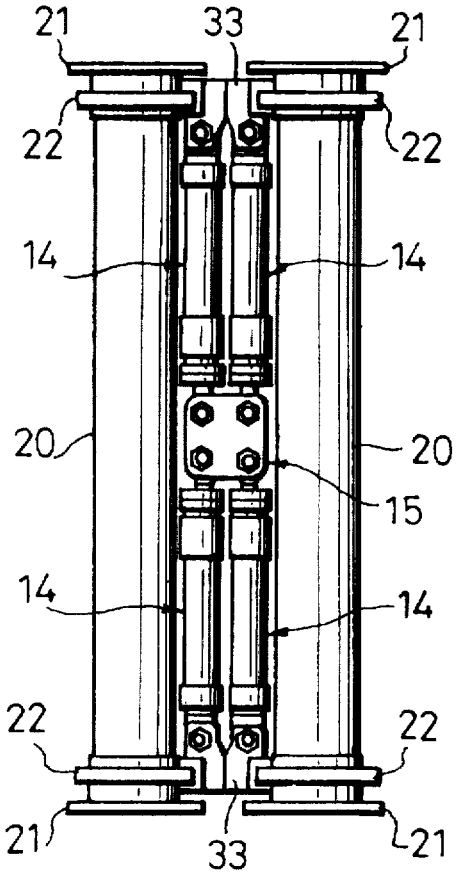
FIG. 8 is a right side view of the shore shown in FIG. 1 in a state where it is folded.

As shown in FIGS. 1 and 7, one floor plate 12 is formed with an opening 50, which is opened and closed by a closeable lid 51. A ladder 52 is vertically inserted into the outside of the opening 50, and the upper and lower ends of the ladder 52 are detachably connected to the upper and lower handrail columns 23, 24 constituting the fixed frame 10 through the bracket. Accordingly, an operator can step up and down on the floor plate 12 from the ground through the ladder 52 and the opening 50.

Figure 9:
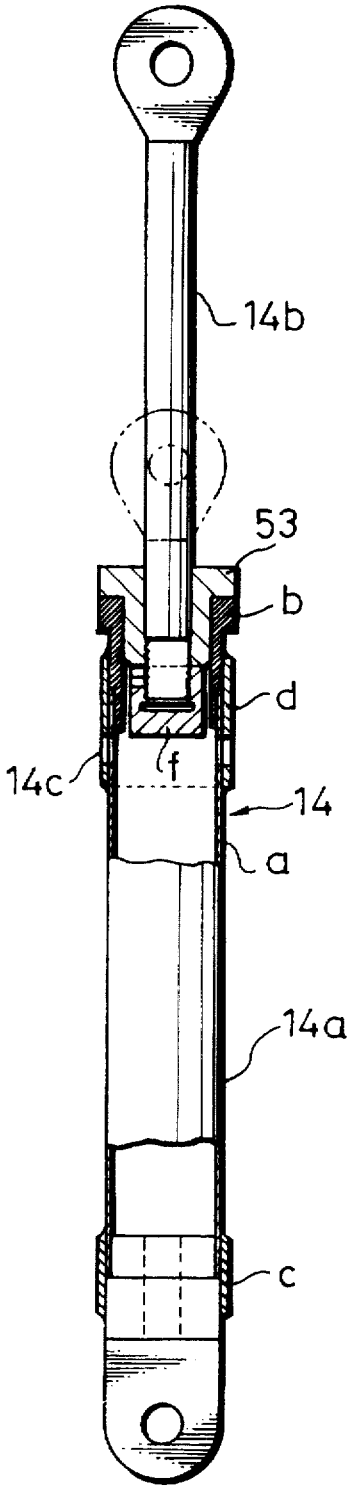
FIG. 9 is a partly cutaway front view of the frame.

The brace 14 comprises, as shown in FIG. 9, an outer tube 14*a*, an inner rod 14*b* slidably inserted into the outer tube 14*a* through a bush 53, and a pin insert hole 14*c* diametrically bored in the outer tube 14*a*.

The outer tube 14*a* comprises a tube main body a, a tube body b threadedly attached to an upper end of the tube main body a, a bush 53 spirally connected to an upper end of the tube body b, a reinforcing sleeve c fitted in a lower part of the tube main body a, and a reinforcing sleeve d fitted in an upper part of the tube main body a and an outer periphery of the tube body b, the sleeve d being formed with a pin insert hole opposed to a pin insert hole 14*c*, a pin for a stopper being inserted into the pin insert hole 14*c*.

Further, the inner rod 14*b* comprises a rod main body, and a stopper f mounted on the lower end of the rod main body. When the brace 14 is expanded, the stopper f comes in contact with the lower end of the bush 53 to provide a stop, and the movement in the compressing direction is controlled by the pin inserted into the pin insert hole 14*c*. When in compression, the pin is drawn in advance out of the pin insert hole 14*c*. The sliding movement in the compressing direction can be then obtained.

The inner rod 14*b* and the outer tube 14*a* are constituted by installing many parts in order to increase the strength thereof and positively perform plating and dip welding.

While the shore according to the above-described embodiment can be used singly, it is to be noted that a plurality of shores are connected in series, the number of which to be put one upon another is selected according to a space between the ground and a heavy article to be supported, for example, a bridge girder.

The shore shown in FIG. 1 is fabricated in advance at a factory and is transported in the form folded compactly to a costruction site. In the construction site, when the front (the left hand in FIG. 1) fixed frame 10 is connected to a crane and lifted, the brace 14, the handrail column 13 and the support rod 18 are automatically expanded due to the own weight from the fixed frame 10 to form a cubic box-like configuration. At this time, the lower end of the support rod 18 is connected to the guide tube 17 through the bolt 44.

The shore formed into a box-like configuration is caused to stand up on the ground through the lower end of the pipe column 20 as shown in FIG. 1, and the load of the heavy article from the top is carried by the fixed frame 10 and the reinforcing frame 11. Further, the lengthwise load caused by the vibrations or the like is carried mainly by the reinforcing frame 11 constituted by four braces 14 and the handrail column 13 so that the box-like shape of the shore is not deformed.

Figure 12:
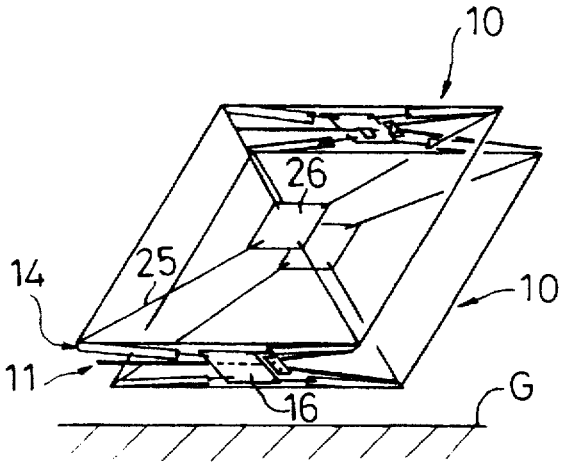
FIG. 12 is a schematic view of the shore shown in FIG. 1 in a state where it is folded.
Figure 10:
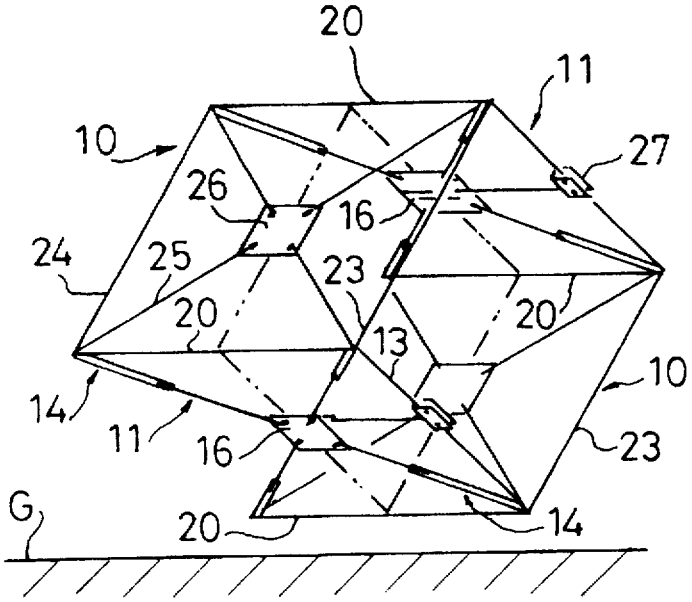
FIG. 10 is a schematic view of the shore shown in FIG. 1.
Figure 11:
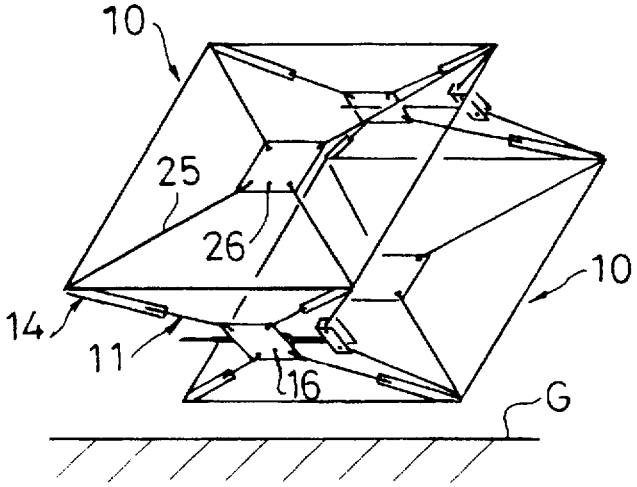
FIG. 11 is a schematic view of the shore shown in FIG. 1 in a state where it is being folded.

In the case where the shore is folded compactly after use, the front fixed frame 10 is again lifted by the crane, and the rear fixed frame 10 is put on the ground while changing the direction by 90 degrees from the state shown in FIG. 1. That is, as shown in FIGS. 10, 11 and 12, for example, when the front fixed frame 10 is lifted by the crane or the like and subsequently the rear fixed frame 10 is put on the ground, the shore is folded by the own weight from the front fixed frame 10. In this case, the pin inserted in advance into the pin insert hole 14*c* of the brace 14 is drawn out, and the mounted bolt 44 is removed from the support rod 18. In this state, when the weight from the front fixed frame 10 is exerted in the direction of the ground, the braces 14 are compressed and rotate about the pivotal point of the proximal end in the direction along the pipe columns 10.

The handrail column 13 is likewise rotated about the proximal end in the direction along the pipe columns 10, and at the same time folded through the central bracket 27. At this time, the support rod 18 is slidably moved by being guided by the guide tube 17 to smoothly guide the compression of the shore. Further, the floor plates 12 are rotated about the proximal end, the extreme end thereof is moved downward integral with the support rod 18 and folded in the state along the pipe columns 10.

Figure 13:
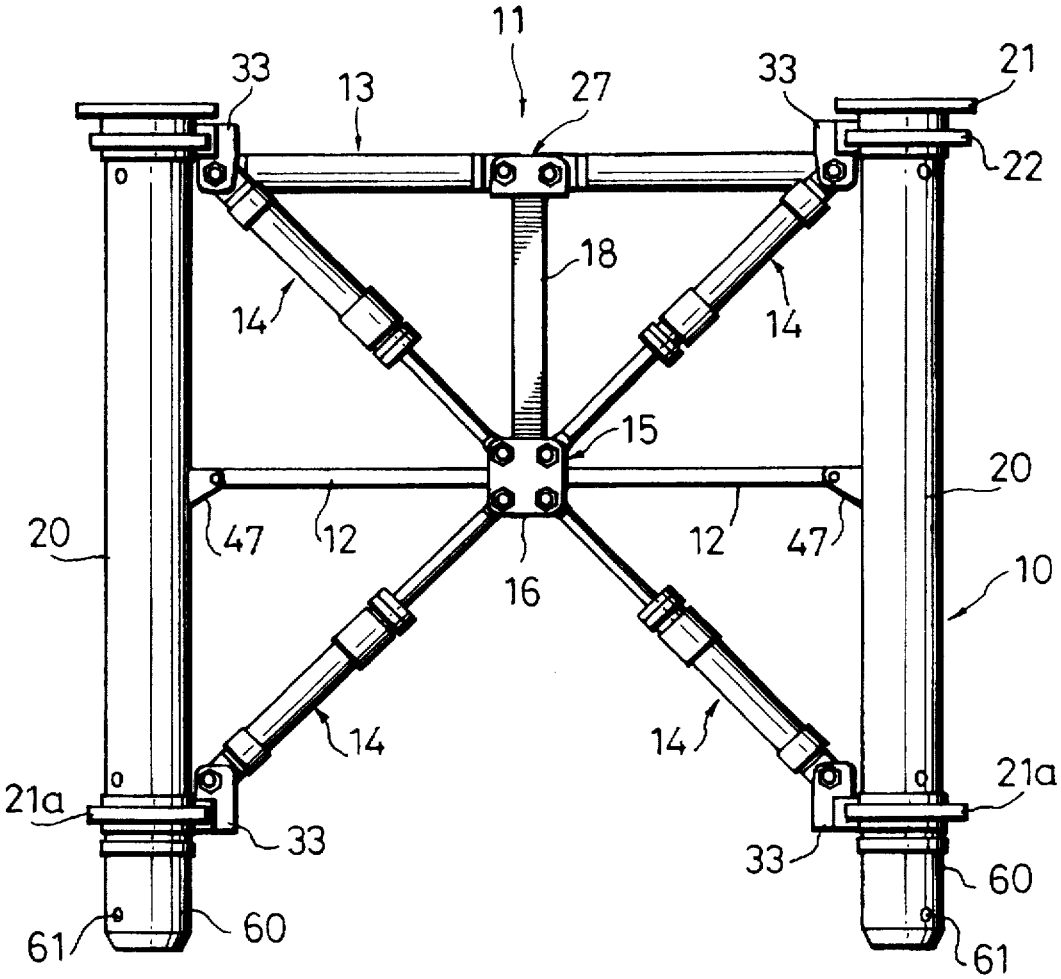
FIG. 13 is a right side view of the reinforcing frame in the shore according to another embodiment.

FIG. 13 shows another embodiment of the present invention, in which a pipe column 10 is formed at the lower end with a guide rod 60, the guide rod 60 is inserted into the upper end of a pipe column 20 in the lower shore and connected through a pin hole 61 formed in the guide rod 60. In this case, the lower flange 21*a* is different from that of the embodiment shown in FIG. 1 in that it is formed out of a single plate and the lower end of the brace 14 is connected to it.

Figure 14:
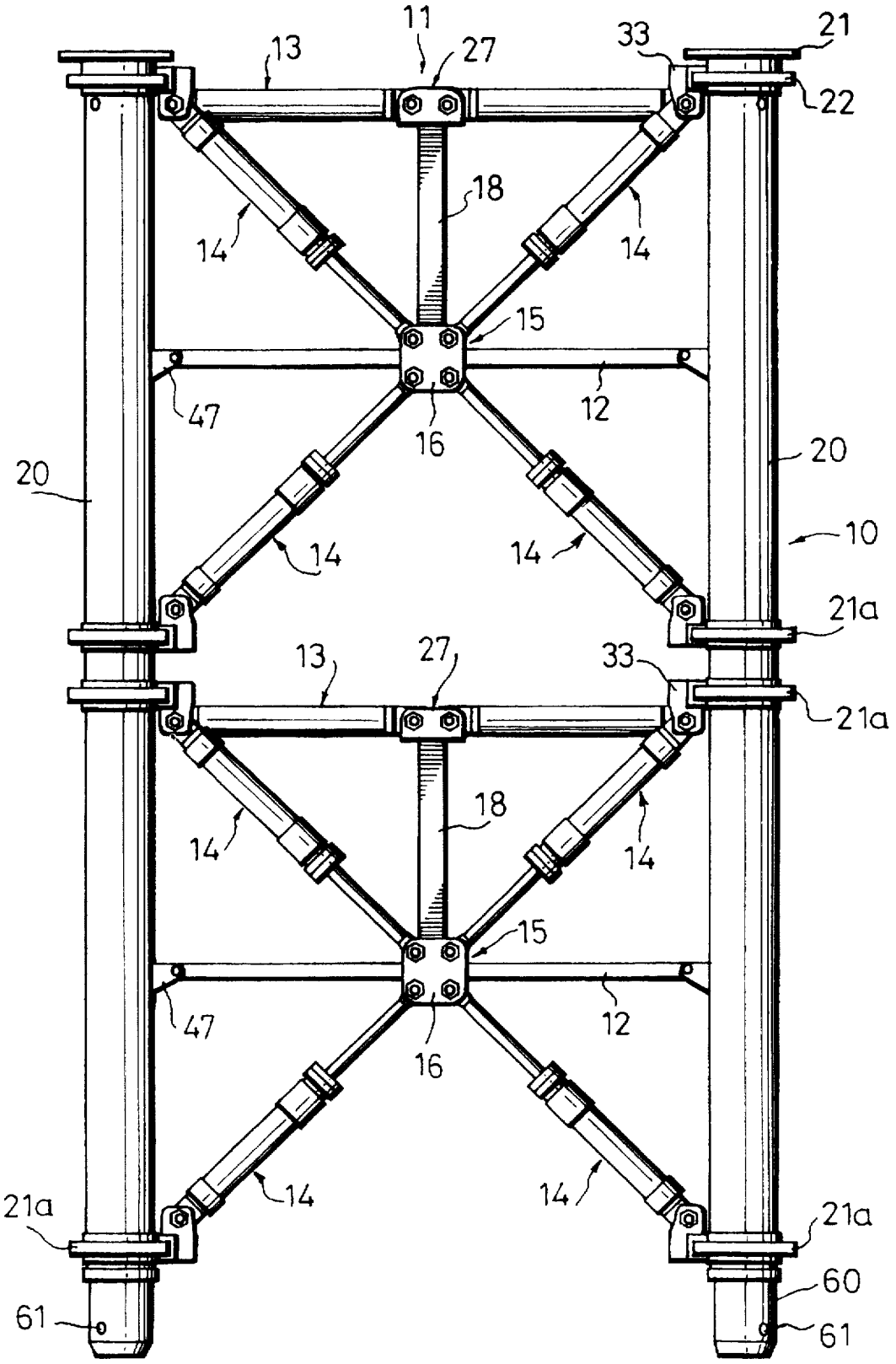
FIG. 14 is a right side view of the reinforcing frame in the shore according to still another embodiment.

FIG. 14 likewise shows still another embodiment of the present invention, in which front and rear fixed frames 10 are formed out of a lengthy pipe columns 20, and two upper and lower reinforcing frames 11, 11 are provided on the side of the fixed frame 10. The pipe column 20 is provided at the lower end with a guide rod 60 and a flange 21*a*. Other structures, operations and effects are similar to those of the embodiment shown in FIG. 1.

Figure 15:
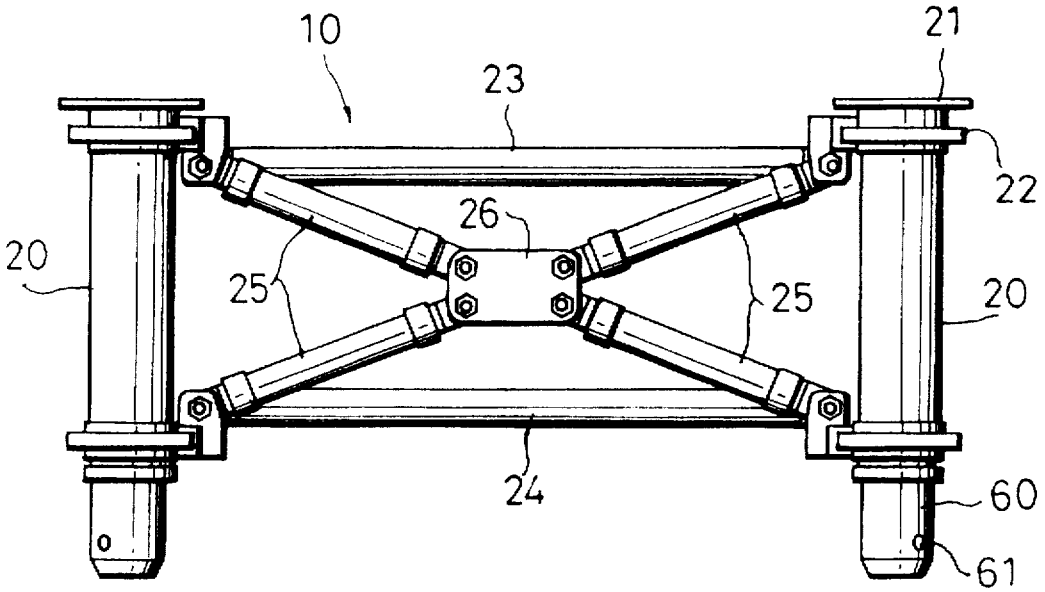
FIG. 15 is a front view of the fixed frame of the shore according to another embodiment.
Figure 17:
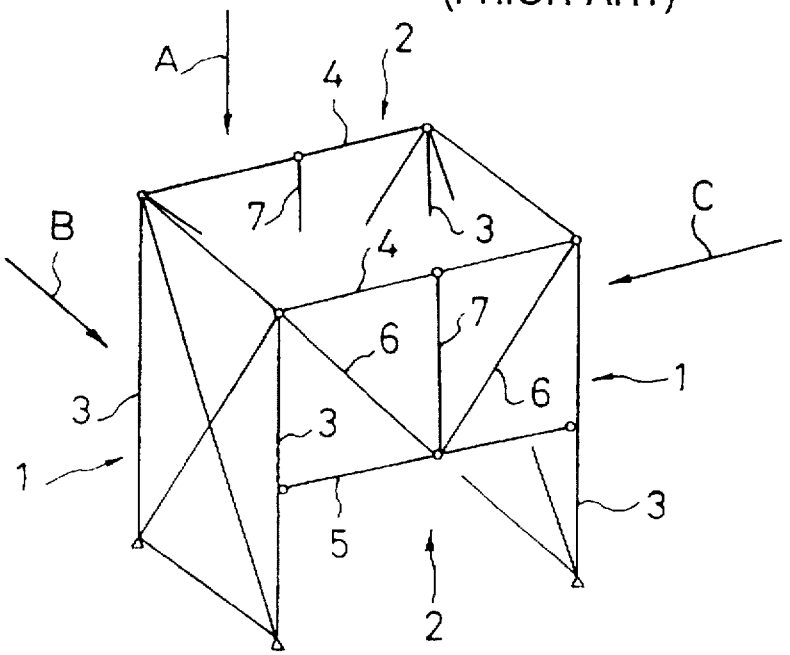
Fig. 17 (PRIOR ART)
FIG. 17 is a schematic perspective view of a conventional shore.

FIG. 15 likewise shows another embodiment of the present invention, which is a shore for adjusting a height when a plurality of shores are mounted in a longitudinal direction. The fundamental configuration thereof is the same as that of the previous embodiments except that the length of a pipe column 20 is short and the folding construction is not employed.

Figure 16:
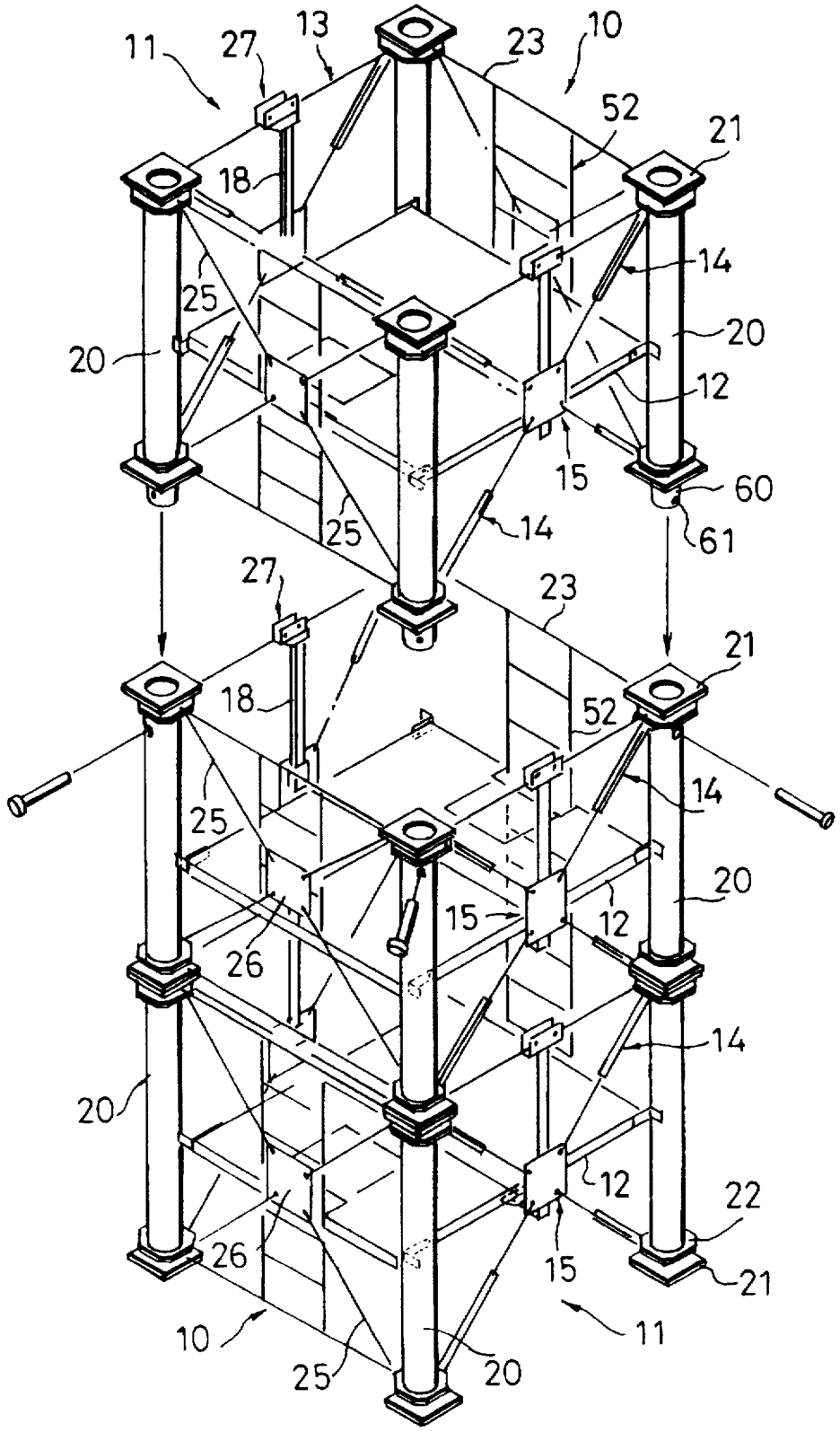
FIG. 16 is a perspective view of the shore according to another embodiment.

FIG. 16 shows the state of use where a plurality of the shores according to the previous embodiments are vertically mounted. In this case, vertical pipe columns 20, 20 are connected together through a flange 21 or a guide rod is inserted into a hole of the flange 21.

Moreover, the lower shore and the upper shore are assembled in such a manner as to invert the front and rear thereof, whereby an opening 50 formed in a floor plate 12 is provided so that the upper side and the lower side thereof are to be alternated, and an operator can step up and down in a zigzag manner. It is of course that the position of the opening 50 may be set so that the upper and lower positions thereof are to be the same. However, since they are set alternately as described above, tools or the like are prevented from being fallen from the top down to the ground or the operator is prevented from being fallen.

The shores according to claims of the present invention have the following effects.

(1) The reinforcing frame is provided with a horizontal handrail column, four crossed braces, a support member for supporting an extreme end of each brace, and a support rod connected to the handrail column and the support member. Therefore, the support force against vertical and lengthwise loads is large, the strength is increased and the durability is improved. For this reason, even if the compressive force caused by the load due to the heavy article in the vertical direction, the vibrations in the lengthwise direction or the like are exerted on the shore, the shore itself is not deformed.

(2) Since the brace expands and contracts in the state of being connected to the pipe column and the support member, when in folding, no operation of releasing such a connection is involved, thus materially improving the workability.

What is claimed is:

1. A shore comprising:

a fixed frame and another fixed frame, said fixed frame and said another fixed frame being opposed to each other, said fixed frame having an inner intermediate portion and said another fixed frame having an inner intermediate portion, said fixed frame having first and second upper ends and first and second lower ends and said another fixed frame having first and second upper ends and first and second lower ends;

a floor plate and another floor plate, said floor plate having a proximal end, pivotally mounted to said inner intermediate portion of said fixed frame, and an extreme end and said another floor plate having a proximal end, pivotally mounted to said inner intermediate portion of said another fixed frame, and an extreme end;

a foldable reinforcing frame interposed between ends of said fixed frame and another foldable reinforcing frame interposed between ends of said another fixed frame, said reinforcing frame including a folding handrail column with proximal ends pivotally mounted to upper ends of said fixed frame and said another reinforcing frame including another folding handrail column with a proximal ends pivotally mounted to upper ends of said another fixed frame;

a set of four expandable braces with ends pivotally mounted to said first and second upper ends and said first and second lower ends of said fixed frame and obliquely extending toward said inner inter-mediate portion of said fixed frame and another set of four expandable braces with ends pivotally mounted to said first and second upper ends and said first and second lower ends of said another fixed frame and obliquely extending toward said inner inter-mediate portion of said another fixed frame;

a support member with a guide tube, said support member comprising a flange pivotally mounting an extreme end of each brace of said set of four expandable braces;

a support rod with a proximal end secured to an intermediate portion of said handrail column and with a lower end secured into or slidably and selectively inserted into said guide tube; and a bracket provided at said lower end of said support rod and rotatably connected to said extreme end of said floor plate.

2. The shore according to claim 1, where in said fixed frame comprises left and right hollow pipe columns, a set of two upper and lower flanges provided at upper and lower ends of the pipe columns, a fixed frame upper handrail column and a fixed frame lower handrail column connected via said upper and lower flanges between upper ends of the pipe columns and between the lower ends thereof, four braces with proximal ends connected to the upper and lower ends of the pipe columns and with extreme ends extending obliquely towards said inner intermediate portion of said fixed flange, and a support plate for connecting said extreme end of each of said braces.

3. The shore according to claim 1, wherein said set of expandable braces and said another set of expandable braces comprises an outer tube, an inner rod slidably inserted into said outer tube, and a pin insert hole diametrically bored on the upper part of the outer tube.

4. The shore according to claim 1, wherein said folding handrail column comprises a pair of front and rear columns and a bracket, an extreme end of each of said front and rear columns being pivotally mounted to said bracket, and an upper end of said support rod is connected to a support piece extended horizontally from said bracket.

5. The shore according to claim 1, wherein said fixed frame and said another fixed frame are longitudinally lengthy fixed frames said foldable reinforcing frame being provided below a second foldable reinforcing frame disposed between said longitudinally lengthy fixed frames and said another foldable reinforcing frame being provided below a second another foldable reinforcing frame disposed between said longitudinally lengthy fixed frames and a second floor plate is interposed between said longitudinally lengthy fixed frames.

6. The shore according to claim 1, wherein a plurality of shores may be connected detachably in a vertical direction.

7. The shore according to claim 1, wherein said proximal end of said folding handrail column and ends of said four expandable braces are pivotably mounted to one out of the set of two upper and lower flanges provided on the pipe columns.

8. A shore comprising:

a fixed frame and another fixed frame, said fixed frame and said another fixed frame being opposed to each other, said fixed frame having an inner intermediate portion and said another fixed frame having an inner intermediate portion, said fixed frame having first and second upper ends and first and second lower ends and said another fixed frame having first and second upper ends and first and second lower ends;

a floor plate and another floor plate, said floor plate having a proximal end, pivotally mounted to said inner intermediate portion of said fixed frame, and an extreme end and said another floor plate having a proximal end, pivotally mounted to said inner intermediate portion of said another fixed frame, and an extreme end;

a foldable reinforcing frame interposed between ends of said fixed frame and another foldable reinforcing frame interposed between ends of said another fixed frame, said reinforcing frame including a folding handrail column with proximal ends pivotally mounted to upper ends of said fixed frame and said another reinforcing frame including another folding handrail column with proximal ends pivotally mounted to upper ends of said another fixed frame;

a set of four expandable braces with ends pivotally mounted to said first and second upper ends and said first and second lower ends of said fixed frame and obliquely extending toward said inner inter-mediate portion of said fixed frame and another set of four expandable braces with ends pivotally mounted to said first and second upper ends and said first and second lower ends of said another fixed frame and obliquely extending toward said inner inter-mediate portion of said another fixed frame;

a support member with a guide tube, said support member comprising a flange pivotally mounting an extreme end of each brace of said set of four expandable braces and another support member with another guide tube, said another support member comprising another flange pivotally mounting an extreme end of each brace of said another set of four expandable braces;

a support rod with a proximal end secured to an intermediate portion of said handrail column and with a lower end secured into or slidably and selectively inserted into said guide tube and another support rod with a proximal end secured to an intermediate portion of said another handrail column and with a lower end secured into or slidably and selectively inserted into said another guide tube; and a bracket provided at said lower end of said support rod and rotatably connected to said extreme end of said floor plate and another bracket provided at said lower end of said another support rod and rotatably connected to said extreme end of said floor plate.

9. The shore according to claim 8, wherein said fixed frame comprises left and right hollow pipe columns, a set of two upper and lower flanges provided at upper and lower ends of the pipe columns, a fixed frame upper handrail column and a fixed frame lower handrail column connected via said upper and lower flanges between upper ends of the pipe columns and between the lower ends thereof, four braces with proximal ends connected to the upper and lower ends of the pipe columns and with extreme ends extending obliquely towards said inner intermediate portion of said fixed flange, and a support plate for connecting said extreme end of each of said braces.

10. The shore according to claim 8, wherein said set of expandable braces and said another set of expandable braces comprises an outer tube, an inner rod slidably inserted into said outer tube, and a pin insert hole diametrically bored on the upper part of the outer tube.

11. The shore according to claim 8, wherein said folding handrail column comprises a pair of front and rear columns and a bracket, an extreme end of each of said front and rear columns being pivotally mounted to said bracket, and an upper end of said support rod is connected to a support piece extended horizontally from said bracket.

12. The shore according to claim 8, wherein said fixed frame and said another fixed frame are longitudinally lengthy fixed frames said foldable reinforcing frame being provided below a second foldable reinforcing frame disposed between said longitudinally lengthy fixed frames and said another foldable reinforcing frame being provided below a second another foldable reinforcing frame disposed between said longitudinally lengthy fixed frames and a second floor plate is interposed between said longitudinally lengthy fixed frames.

13. The shore according to claim 8, wherein a plurality of shores may be connected detachably in a vertical direction.

14. The shore according to claim 8, wherein said proximal end of said folding handrail column and ends of said four expandable braces are pivotably mounted to one out of the set of two upper and lower flanges provided on the pipe columns.

* * * * *